US008356744B2

(12) United States Patent
Brand et al.

(10) Patent No.: US 8,356,744 B2
(45) Date of Patent: Jan. 22, 2013

(54) CARTON WITH REINFORCING INSERT

(75) Inventors: Kirsten L. Brand, Marietta, GA (US); Ana Gonzalez, Barcelona (ES)

(73) Assignee: Graphic Packaging International, Inc., Marietta, GA (US)

( * ) Notice: Subject to any disclaimer, the term of this patent is extended or adjusted under 35 U.S.C. 154(b) by 96 days.

(21) Appl. No.: 12/687,454

(22) Filed: Jan. 14, 2010

(65) Prior Publication Data

US 2011/0068160 A1 Mar. 24, 2011

Related U.S. Application Data

(60) Provisional application No. 61/205,239, filed on Jan. 16, 2009.

(51) Int. Cl.
*B65D 5/42* (2006.01)
*B31B 17/00* (2006.01)

(52) U.S. Cl. ..... 229/199; 493/84; 229/117.13

(58) Field of Classification Search ..... 229/117.26, 229/244; 206/141
See application file for complete search history.

(56) References Cited

U.S. PATENT DOCUMENTS

| | | | |
|---|---|---|---|
| 1,925,102 | A | 9/1933 | Levkoff |
| 2,005,924 | A | 6/1935 | Wilson |
| 2,067,749 | A | 1/1937 | Zimmerman et al. |
| 2,115,673 | A | 4/1938 | Stompe |
| 2,196,502 | A | 4/1940 | Kells |
| 2,299,027 | A | 10/1942 | Novak |
| 2,386,905 | A | 10/1945 | Meitzen |
| 2,648,484 | A | 8/1953 | Belsinger |
| 2,669,351 | A | 2/1954 | Carson et al. |
| 2,754,047 | A | 7/1956 | Schmidt et al. |
| 3,078,032 | A | 9/1963 | Robinson et al. |
| 3,128,010 | A | 4/1964 | Forrer |
| 3,133,634 | A | 5/1964 | Bozdar |
| 3,173,596 | A | 3/1965 | Aust et al. |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| 3,300,115 | A | 1/1967 | Schauer |
| 3,332,594 | A | 7/1967 | De Capua |

(Continued)

FOREIGN PATENT DOCUMENTS

| | | |
|---|---|---|
| CA | 873185 A1 | 6/1971 |
| EP | 0 066029 | 12/1982 |

(Continued)

OTHER PUBLICATIONS

International Search Report for related PCT application No. PCT/US2010/020990, mailed Aug. 30, 2010.

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A carton for containing a plurality of articles. The carton comprises panels that extend at least partially around an interior of the carton. The panels comprise a top panel, a first side panel, a second side panel, and a bottom panel. The carton includes a reinforcing insert comprising at least a first insert panel foldably connected to a second insert panel. The first insert panel is at least partially in face-to-face contact with at least the top panel and the second insert panel is at least partially in face-to-face contact with the first insert panel.

32 Claims, 10 Drawing Sheets

U.S. PATENT DOCUMENTS 3,346,167 A 10/1967 Schmidt
3,356,279 A 12/1967 Root
3,517,858 A 6/1970 Farquhar
3,533,549 A 10/1970 Gilchrist
3,540,581 A 11/1970 Koolnis
3,825,170 A 7/1974 Aust et al.
3,904,036 A * 9/1975 Forrer ..... 206/427
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A 4/1983 Botterman et al.
4,396,143 A 8/1983 Killy
4,417,655 A 11/1983 Forbes, Jr.
4,417,661 A 11/1983 Roccaforte
4,538,759 A 9/1985 Dutcher
4,577,762 A 3/1986 Kuchenbecker
4,588,084 A * 5/1986 Holley, Jr. ..... 206/427
4,605,128 A 8/1986 Rieke
4,621,766 A 11/1986 McClure
4,658,984 A 4/1987 Brunner
4,757,938 A 7/1988 Collins
4,817,866 A 4/1989 Wonnacott
4,830,267 A 5/1989 Wilson
4,890,440 A 1/1990 Romagnoli
4,949,845 A 8/1990 Dixon
4,967,901 A 11/1990 Wood
4,974,771 A 12/1990 Lavery
5,072,876 A 12/1991 Wilson
5,101,642 A 4/1992 Alexandrov
5,119,985 A 6/1992 Dawson et al.
5,137,211 A 8/1992 Summer et al.
5,219,229 A 6/1993 Sengewald
5,249,681 A 10/1993 Miller
5,297,725 A 3/1994 Sutherland
5,320,277 A 6/1994 Stout et al.
5,333,734 A 8/1994 Stout et al.
5,350,109 A 9/1994 Brown et al.
5,425,474 A 6/1995 Dalea et al.
5,482,185 A 1/1996 McNaughton
5,482,203 A 1/1996 Stout
5,505,372 A 4/1996 Edson et al.
5,577,612 A 11/1996 Chesson et al.
5,588,585 A 12/1996 McClure
5,597,114 A 1/1997 Kramedjian et al.
5,622,309 A 4/1997 Matsuda et al.
5,664,683 A 9/1997 Brody
5,690,213 A 11/1997 Matsumura
5,690,230 A 11/1997 Griffith
5,794,778 A 8/1998 Harris
5,826,783 A 10/1998 Stout
5,873,516 A 2/1999 Boggs
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
6,050,402 A 4/2000 Walter
6,170,741 B1 1/2001 Skolik et al.
6,176,419 B1 1/2001 Holley, Jr.
6,250,542 B1 6/2001 Negelen
6,283,293 B1 9/2001 Lingamfelter
6,302,320 B1 10/2001 Stout
6,409,077 B1 6/2002 Telesca et al.
D459,927 S 7/2002 Flowers et al.
6,471,120 B1 10/2002 Vogel
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,631,803 B2 10/2003 Rhodes et al.
6,669,083 B2 12/2003 Bates
6,715,639 B2 4/2004 Spivey
6,752,262 B1 6/2004 Boriani et al.
6,789,673 B2 9/2004 Lingamfelter
6,848,573 B2 2/2005 Gould et al.
6,866,186 B2 3/2005 Fogle et al.
6,902,104 B2 6/2005 Holley, Jr. et al.
6,918,487 B2 7/2005 Harrelson
6,926,193 B2 8/2005 Smalley
6,929,172 B2 8/2005 Bates et al.
6,932,265 B2 8/2005 Sax et al.
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,073,665 B2 7/2006 Auclair et al.
7,104,435 B2 9/2006 Holley, Jr.
7,134,593 B2 11/2006 Harrelson
7,159,759 B2 1/2007 Sutherland et al.
7,225,930 B2 6/2007 Ford et al.
7,422,104 B2 9/2008 Perkinson
7,478,743 B2 1/2009 Holley, Jr.
7,604,157 B2 10/2009 Zammit et al.
7,699,215 B2 4/2010 Spivey, Sr.
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0006158 A1 1/2003 Skolik et al.
2003/0136820 A1 7/2003 Negelen
2003/0141313 A1 7/2003 Bates
2003/0150759 A1 8/2003 White, Jr.
2003/0192907 A1 10/2003 Bates
2004/0040334 A1 3/2004 Rusnock
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0188277 A1 9/2004 Auclair
2004/0188300 A1 9/2004 Sutherland
2004/0188508 A1 9/2004 Holley, Jr. et al.
2005/0023170 A1 2/2005 Lingamfelter
2005/0092820 A1 5/2005 Chekroune
2005/0115843 A1 6/2005 Harrelson
2005/0126947 A1 6/2005 Holley, Jr.
2005/0167291 A1 8/2005 Sutherland
2005/0167478 A1 8/2005 Holley, Jr.
2005/0189405 A1 9/2005 Gomes et al.
2005/0263574 A1 12/2005 Schuster
2006/0054522 A1 3/2006 Kline et al.
2006/0081691 A1 4/2006 Smalley
2006/0091193 A1 5/2006 DeBusk
2006/0118606 A1 6/2006 Holley, Jr. et al.
2006/0131370 A1 6/2006 Bates
2006/0175386 A1 8/2006 Holley, Jr.
2006/0231441 A1 10/2006 Gomes
2006/0231600 A1 10/2006 Holley, Jr.
2006/0249413 A1 11/2006 Auclair et al.
2006/0278689 A1 12/2006 Boshinski et al.
2007/0007325 A1 1/2007 Suzuki et al.
2007/0029371 A1 2/2007 Theelen
2007/0108261 A1 5/2007 Schuster
2007/0131748 A1 6/2007 Brand
2007/0164093 A1 7/2007 Spivey et al.
2007/0181658 A1 8/2007 Sutherland
2007/0205255 A1 9/2007 Dunn
2007/0210144 A1 9/2007 Brand
2007/0251982 A1 11/2007 Brand
2008/0023535 A1 1/2008 Holley, Jr.
2008/0048014 A1 2/2008 Bates
2008/0128479 A1 6/2008 Bates et al.
2009/0282843 A1 11/2009 Brand
2010/0044420 A1 2/2010 Brand
2010/0122999 A1 5/2010 Brand
2010/0237138 A1 9/2010 Bradford

FOREIGN PATENT DOCUMENTS

| | | | |
|---|---|---|---|
| EP | 1 433 714 | A2 | 6/2004 |
| EP | 1 698 565 | A2 | 9/2006 |
| FR | 2 549 010 | | 1/1985 |
| GB | 2 264 101 | A | 8/1993 |
| JP | 2002-128064 | A | 5/2002 |
| JP | 2007-532421 | A | 11/2007 |
| KR | 10-0154124 | B1 | 2/1999 |
| KR | 10-0371048 | B1 | 8/2003 |
| WO | WO 96/21603 | | 7/1996 |
| WO | WO 96/29260 | | 9/1996 |
| WO | WO 99/28198 | | 6/1999 |
| WO | WO 99/64301 | | 12/1999 |
| WO | WO 00/03937 | | 1/2000 |
| WO | WO 02/47990 | A2 | 6/2002 |
| WO | WO 2004/043790 | A2 | 5/2004 |
| WO | WO 2005/051781 | | 6/2005 |
| WO | WO 2005/100175 | A1 | 10/2005 |
| WO | WO 2006/050210 | A2 | 5/2006 |
| WO | WO 2006/050316 | A1 | 5/2006 |
| WO | WO 2007/076544 | A1 | 7/2007 |

OTHER PUBLICATIONS

Written Opinion for related PCT application No. PCT/US US2010/020990, mailed Aug. 30, 2010.

International Search Report and Written Opinion for PCT/US2010/041971, dated Mar. 1, 2011.

International Search Report and Written Opinion, mailed May 30, 2011, PCT/US2010/047102.

International Search Report and Written Opinion dated Oct. 25, 2011 for PCT/US2011/037872.

Supplementary European Search Report for EP 10 75 4034 dated May 30, 2012.

International Search Report and Written Opinion from PCT/US2010/027597 dated Oct. 27, 2010.

International Search Report and Written Opinion for PCT/US2011/051905 dated Apr. 23, 2012.

International Search Report and Written Opinion from PCT/US2011/055233 dated May 17, 2012.

* cited by examiner

CARTON WITH REINFORCING INSERT

CROSS-REFERENCE TO RELATED APPLICATIONS

This application claims the benefit of U.S. Provisional Patent Application No. 61/205,239, filed Jan. 16, 2009.

INCORPORATION BY REFERENCE

U.S. Provisional Patent Application No. 61/205,239, which was filed on Jan. 16, 2009, is hereby incorporated by reference for all purposes as if presented herein in its entirety.

BACKGROUND OF THE DISCLOSURE

The present disclosure generally relates to cartons for holding and dispensing beverage containers or other types of articles. More specifically, the present disclosure relates to cartons having a reinforcing insert.

SUMMARY OF THE DISCLOSURE

In general, one aspect of the disclosure is directed to a carton for containing a plurality of articles. The carton comprises a plurality of panels that extend at least partially around an interior of the carton. The plurality of panels comprise a top panel, a first side panel, a second side panel, and a bottom panel. The carton also comprises a reinforcing insert comprising at least a first insert panel foldably connected to a second insert panel. The first insert panel is at least partially in face-to-face contact with at least the top panel and the second insert panel is at least partially in face-to-face contact with the first insert panel.

In general, another aspect of the disclosure is directed to the combination of a carton blank and an insert blank for forming a carton having reinforced features. The carton blank comprises a plurality of panels comprising a top panel, a first side panel, a second side panel, and a bottom panel. The insert blank comprises at least a first insert panel foldably connected to a second insert panel. The first insert panel is at least partially in face-to-face contact with at least the top panel and the second insert panel is at least partially in face-to-face contact with the first insert panel.

In general, another aspect of the disclosure is directed to a method of forming a carton. The method comprises obtaining a carton blank comprising a plurality of panels comprising a top panel, a first side panel, a second side panel, and a bottom panel. The method further comprises obtaining an insert blank comprising at least a first insert panel foldably connected to a second insert panel. The method further comprises positioning the first insert panel to be at least partially in face-to-face contact with at least the top panel, and positioning the second insert panel to be at least partially in face-to-face contact with at least the first insert panel.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
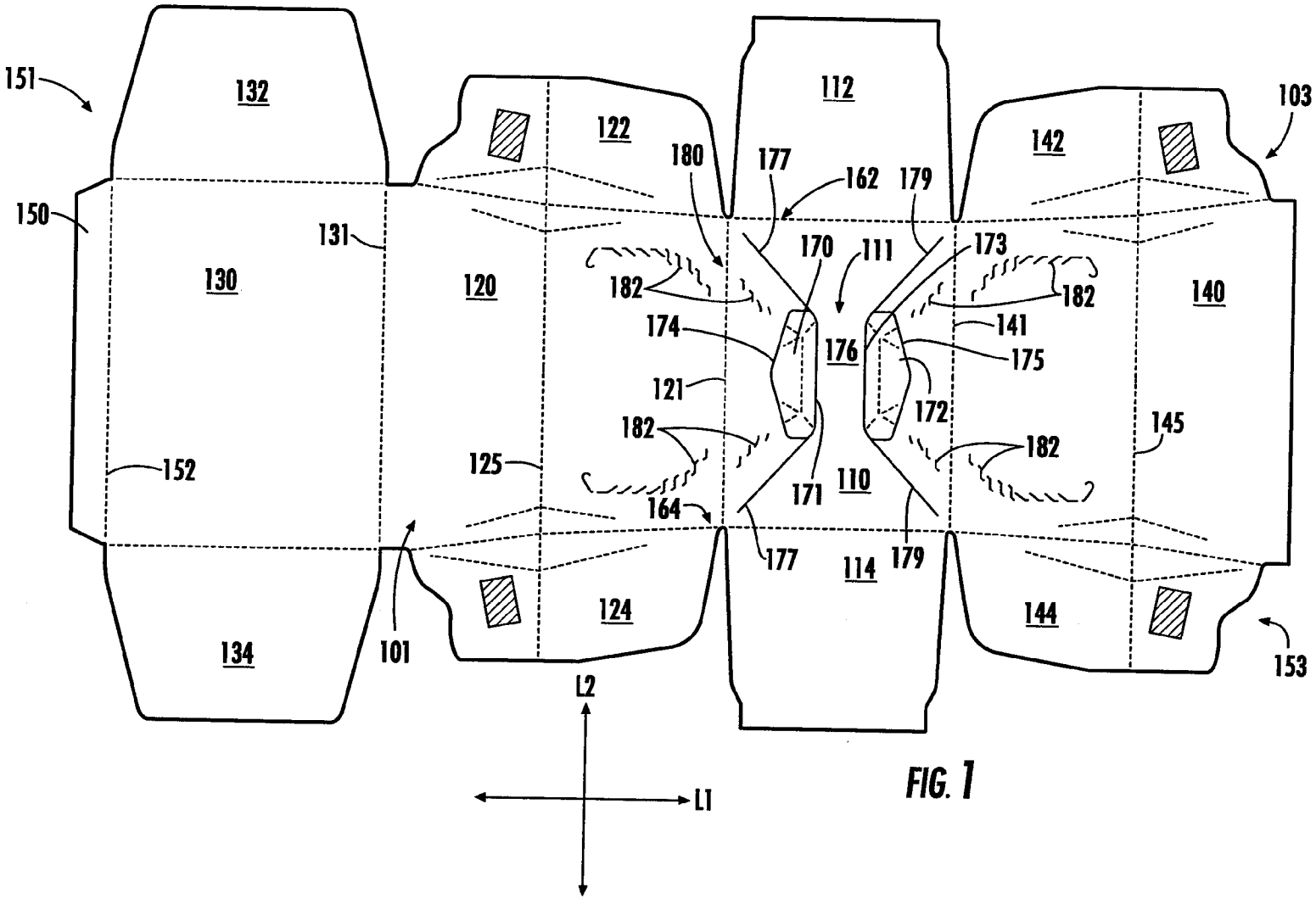
FIG. 1 is a plan view of a carton blank used to form an exemplary fully enclosed carton according to one embodiment of the disclosure.
Figure 9:
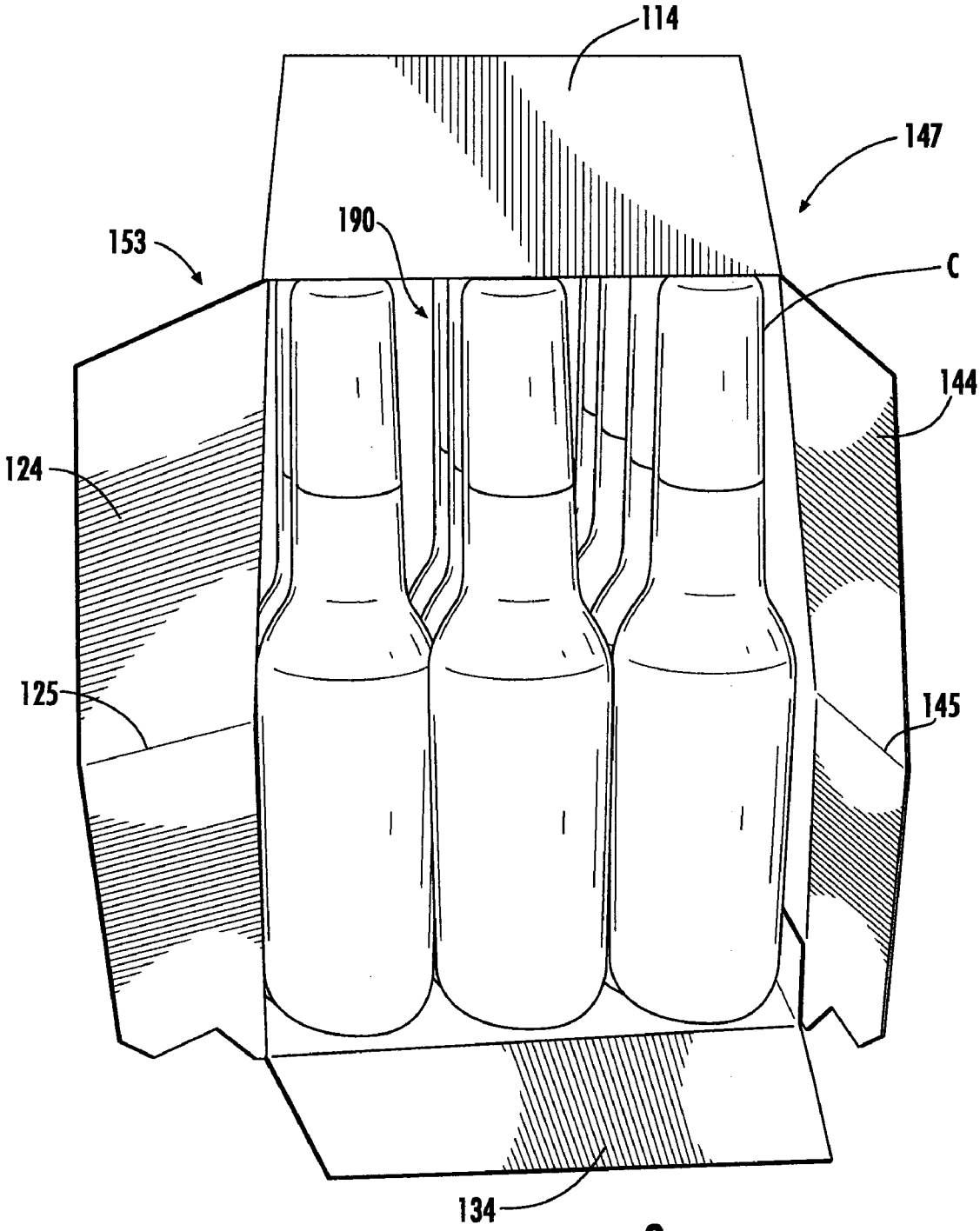
FIG. 9 is a perspective view of the interior of the sleeve loaded with containers.
Figure 10:
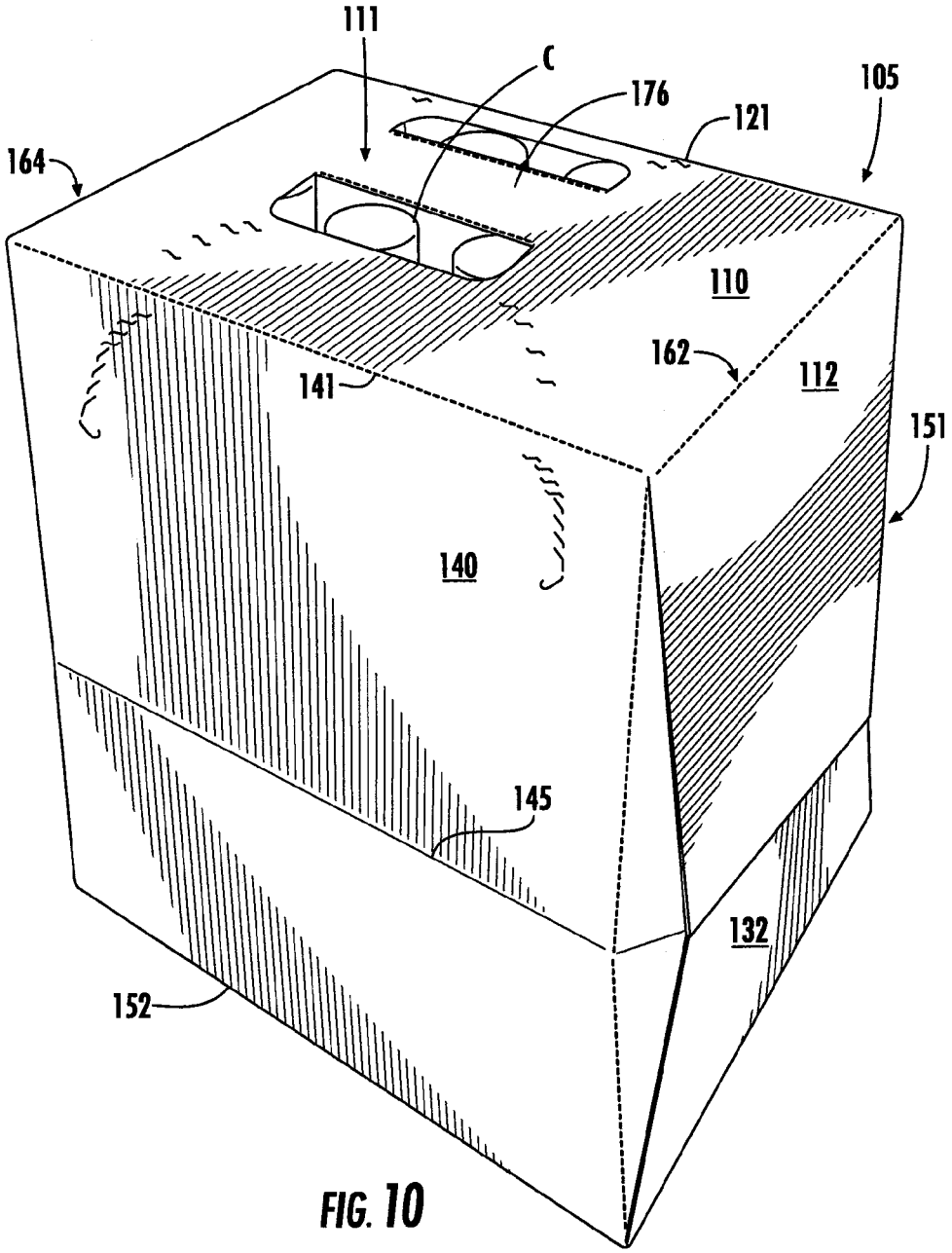
FIG. 10 is a perspective view of the carton according to one embodiment of the disclosure.

FIG. 1 is a plan view of the exterior side 101 of a blank, generally indicated at 103, used to form a carton 105 (FIG. 10) according to the exemplary embodiment of the disclosure. The carton 105 can be used to house a plurality of articles such as containers C (FIG. 9). In the illustrated embodiment, the carton 105 is sized to house twelve containers C in a single layer in a 3×4 arrangement, but it is understood that the carton 105 may be sized and shaped to hold containers of a different or same quantity in more than one layer and/or in different row/column arrangements (e.g., 1×6, 3×6, 2×6×2, 4×5, 3×5, 2×9, 2×6, etc.). In the illustrated embodiment, the carton 105 includes a handle, generally indicated at 111, for grasping and carrying the carton 105. As will be discussed below in more detail, the handle 111 is formed from various features in the blank 103. In the illustrated embodiment, a reinforcing blank 203 (FIG. 2) can be used to form a reinforcing insert 205 (FIG. 4) that strengthens the handle 111 of the carton 105. Alternatively the reinforcing blank 203 and reinforcing insert 205 can be used with substantially any fully enclosed carton to reinforce the carton.

The carton blank 103 has a longitudinal axis L1 and a lateral axis L2. In the illustrated embodiment, the blank 103 comprises a top panel 110 foldably connected to a first side panel 120 at a first lateral fold line 121. A bottom panel 130 is foldably connected to the first side panel 120 at a second lateral fold line 131. A second side panel 140 is foldably connected to the top panel 110 at a third lateral fold line 141. In the illustrated embodiment, the blank 103 includes an adhesive flap 150 foldably connected to the bottom panel 130 at a fourth lateral fold line 152. The carton blank 103 may be otherwise configured to have multiple top panels and/or multiple bottom panels without departing from the scope of this disclosure.

In the illustrated embodiment, the top panel 110 is foldably connected to a first top end flap 112 and a second top end flap 114. The first side panel 120 is foldably connected to a first side flap 122 and a second side flap 124. The bottom panel 130 is foldably connected to a first bottom end flap 132 and a second bottom end flap 134. The second side panel 140 is foldably connected to a first side flap 142 and a second side flap 144. When the carton 105 is erected, the top and bottom end flaps 112 and 132 and side end flaps 122 and 142 close a first end 151 (FIG. 10) of the carton, and the top and bottom end flaps 114 and 134 and side end flaps 124 and 144 close a second end 153 of the carton. In accordance with an alternative embodiment of the present disclosure, different flap arrangements can be used for closing the ends 151, 153 of the carton 105.

In one embodiment, the top and bottom end flaps 112 and 132 and side end flaps 122 and 142 extend along a first marginal area of the blank 103, and are foldably connected at a first longitudinal fold line 162 that extends along the length of the blank. The top and bottom end flaps 114 and 134 and side end flaps 124 and 144 extend along a second marginal area of the blank 103, and are foldably connected at a second longitudinal fold line 164 that also extends along the length of the blank. The longitudinal fold lines 162, 164 may be, for example, substantially straight, or offset at one or more locations to account for blank thickness, container shape, or for other factors.

In the illustrated embodiment, the longitudinal fold lines 162, 164 are angled to account for the bottom panel 130, which is larger than the top panel 110. Further, a fold line 125 extending across the first side panel 120 and the side end flaps 122, 124, and a fold line 145 extending across the second side panel 140 and the side end flaps 142, 144, provide creases to allow the side panels 120, 140 to taper inward towards the smaller top panel 110. Thus, the carton 105 follows the contours of containers C, such as long neck bottles. In accordance with an alternative embodiment of the present disclosure, tapers may be otherwise arranged or omitted without departing from the scope of this disclosure (e.g., the carton may be a four-crease carton with two tapered sides as opposed to a six-crease carton with four tapered sides).

As shown in FIG. 1, the features that form the handle 111 of the carton 105 include opposing, elongate handle flaps 170, 172 formed in the top panel 110 and foldably attached to the top panel at respective lateral fold lines 171, 173. In the illustrated embodiment, the features of handle 111 include tear lines 174, 175 and a handle strip 176 between the lateral fold lines 171, 173. Alternatively, the tear lines 174, 175 could be cut lines or other lines of weakening. The elongate handle flaps 170, 172 are shaped and positioned in the blank 103 so that the handle 111 is activated by pressing on the handle flaps and folding the handle flaps inward to form the handle openings in the carton 105 with the handle strip 176 therebetween. The openings are shaped for insertion of a user's fingers during grasping of the carton 105. In the illustrated embodiment, the features that form the handle 111 include oblique fold lines 177, 179 in the top panel 110 extending from respective tear lines 174, 175. The handle 111 may be otherwise shaped and located in the carton 105 and include other features without departing from the scope of this disclosure.

Figure 2:
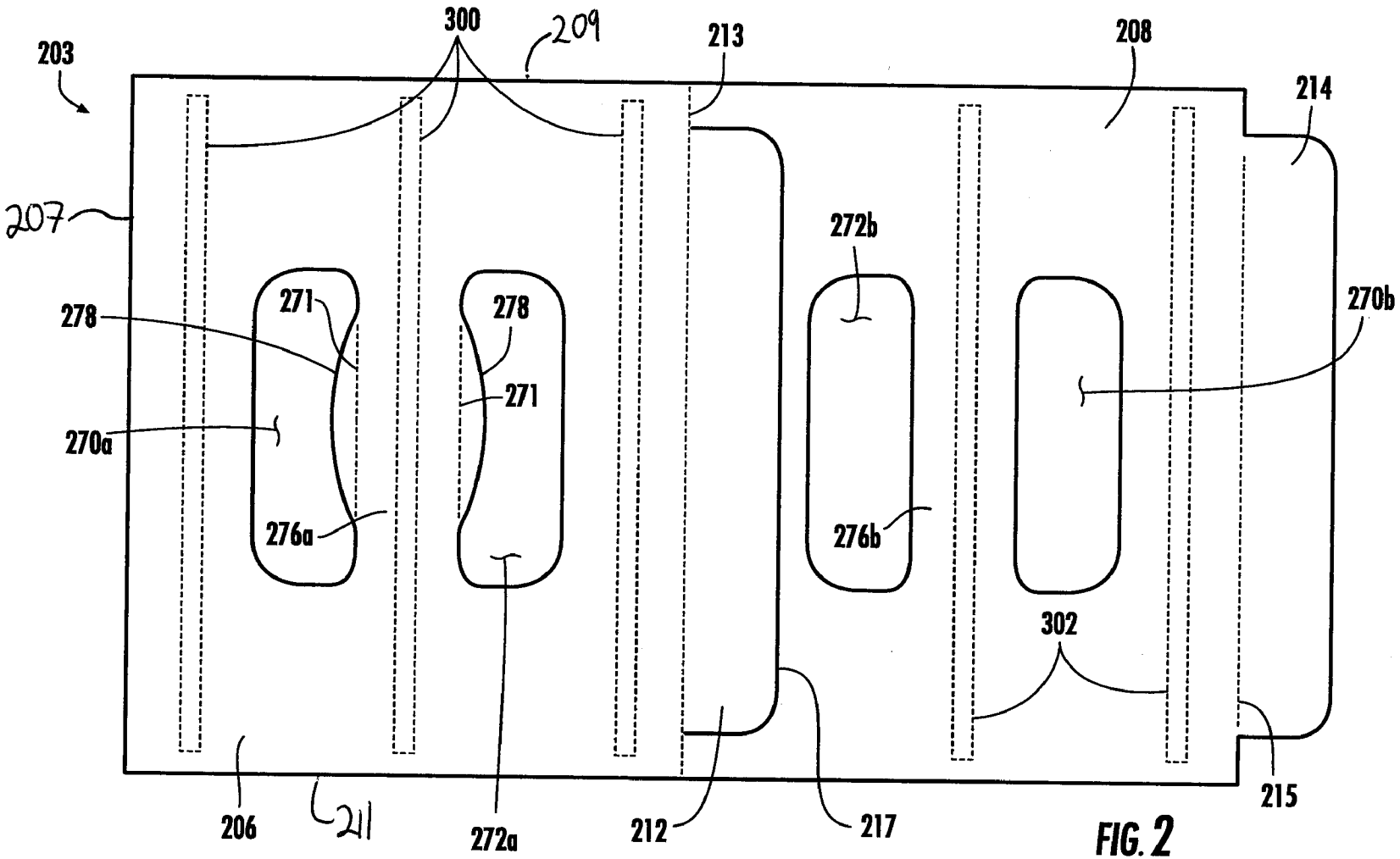
FIG. 2 is a plan view of an insert blank used to form a reinforcing insert for the carton.

FIG. 2 illustrates one embodiment of the insert blank 203 used to form the reinforcing insert 205 (FIG. 4) for use in the carton 105. In the illustrated embodiment, the insert blank 203 includes a first panel 206 and a second panel 208 foldably connected to the first panel at a fold line 213. The second panel 208 comprises a first side flap 212 foldably connected to the first panel 206 at the fold line 213 and defined by a cut line 217 in the second panel 208. A second side flap 214 is foldably connected to the second panel 208 at a fold line 215. The fold lines 213, 215 could be otherwise shaped, arranged, and/or located without departing from the scope of this disclosure.

The first panel 206 comprises a pair of handle openings 270*a*, 272*a* and the second panel 208 comprises a pair of handle openings 270*b*, 272*b*. The handle openings 270*a*, 270*b*, 272*a*, 272*b* provide space for the handle flaps 170, 172 to be pushed into the carton 105 when the reinforced insert 205 is attached to the carton. A pair of hand guards 278 can be foldably attached to the first panel 206 at fold lines 271. A handle strip 276*a* is formed between the handle openings 270*a*, 272*a*, and a handle strip 276*b* is formed between the handle openings 270*b*, 272*b*. The handle openings and the other features of the insert blank 203 could be otherwise shaped and arranged without departing from this disclosure. Particularly, handle flaps may be foldably attached to the first panel 206 and/or the second panel 208 within one or more of the openings 270*a*, 272*a*, 270*b*, 272*b* to further cushion a user's hands when grasping the handle 111.

Figure 3:
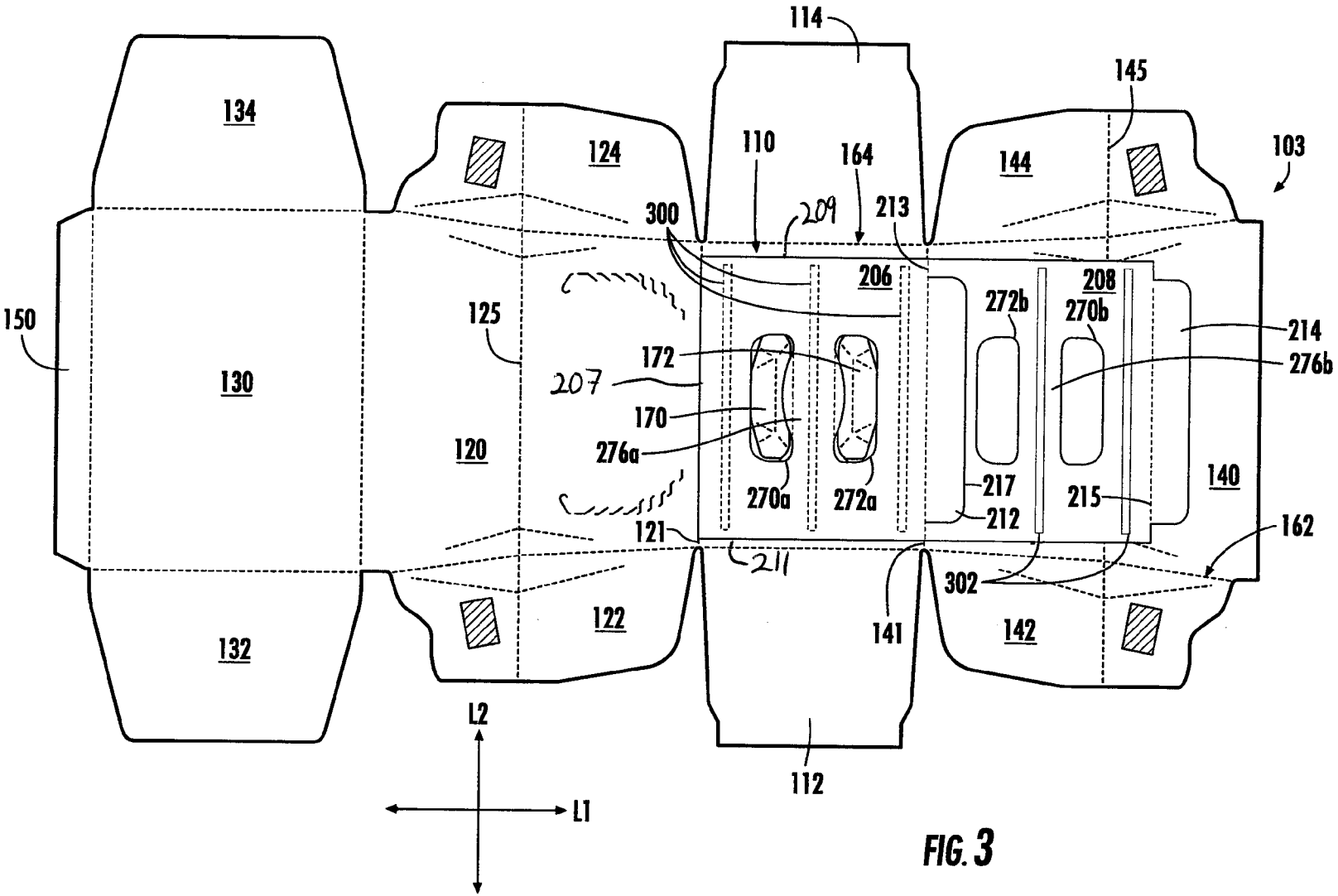
FIGS. 3 and 4 are plan views of the carton blank of FIG. 1 with the reinforcing insert blank of FIG. 2 applied thereto.

As shown in FIG. 3, the carton 105 is assembled by initially adhering the first panel 206 of the insert blank 203 to the interior side of the top panel 110 of the carton blank 103. The first panel 206 is positioned on the carton blank 103 so that the handle openings 270*a*, 272*a* are aligned with the respective handle flaps 170, 172 in the top panel. The fold line 213 of the insert blank 203 generally overlays the third lateral fold line 141 of the carton blank 103. As shown in FIG. 3, the lateral edge 207 of the insert blank 203, corresponding to the lateral edge of the first panel 206, is generally aligned with and overlays the first lateral fold line 121. In the illustrated embodiment, the first panel 206 of the insert blank 203 can be glued to the top panel 110 along glue lines 300. The glue lines 300 may be otherwise shaped, arranged, and/or omitted without departing from this disclosure. The first side flap 212 can be glued to the second side panel 140 of the carton blank 103.

Figure 4:
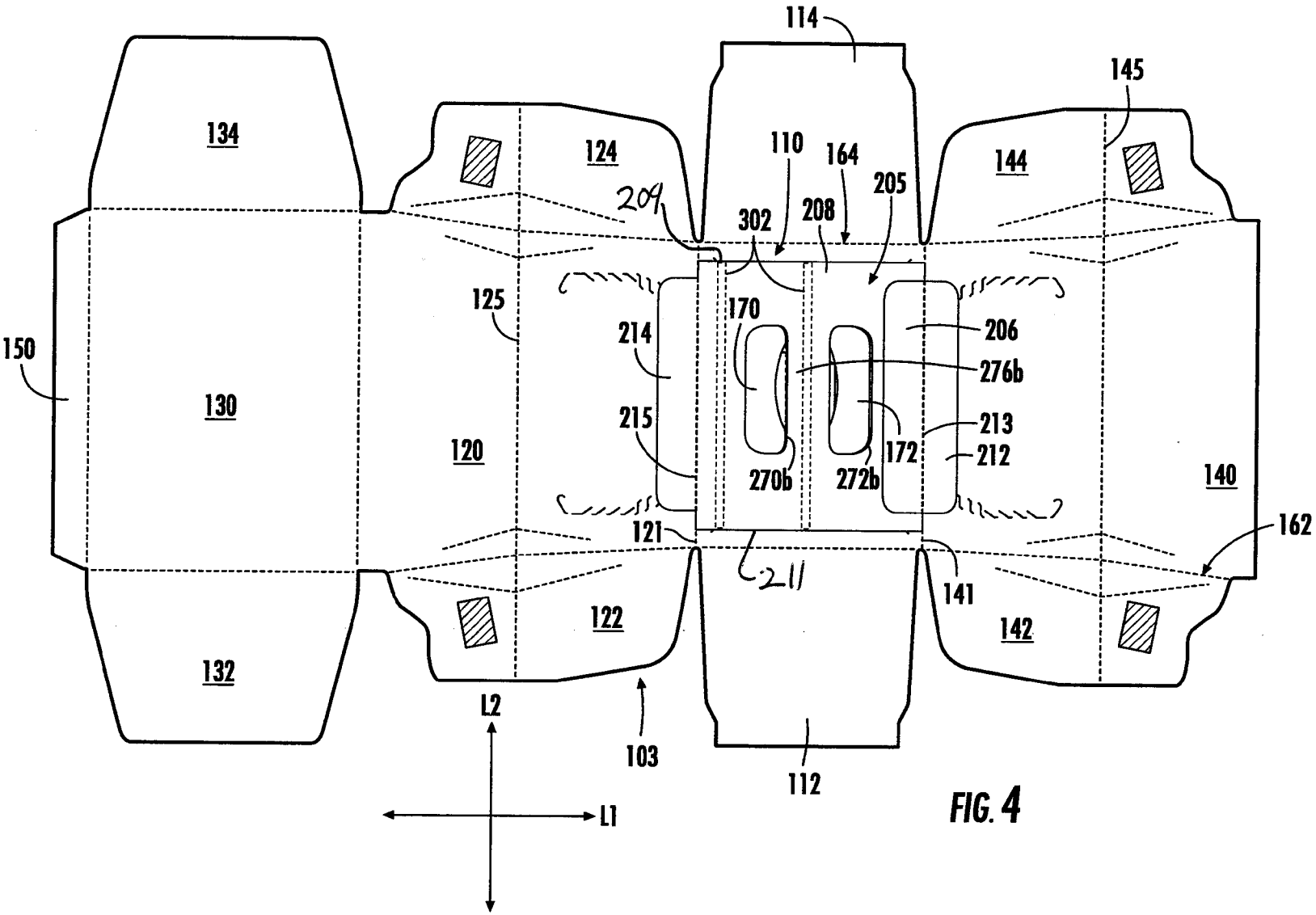

As shown in FIG. 4, the insert blank 203 is folded about the fold line 213, such that the second panel 208 is positioned to be in face-to-face contact with the first panel 206. The second panel 208 is positioned so that the handle openings 270*b*, 272*b* are aligned with and overlay the respective handle openings 270*a*, 272*a* of the first panel 206. The fold line 215 generally overlays the first lateral fold line 121 of the carton blank 103. In the illustrated embodiment, the second panel 208 is glued to the first panel 206 along glue lines 302. The glue lines 302 may be otherwise shaped, arranged, and/or omitted without departing from this disclosure. The second side flap 214 can be glued to the first side panel 120 of the carton blank 103.

As illustrated in the figures, the first panel 206 and the second panel 208 of the insert blank 203 are shorter than the top panel 110 of the carton blank 103 in the lateral (L2) direction so that the longitudinal edges 209, 211 of the reinforcing insert 205 are spaced apart from the longitudinal fold lines 162, 164. In an alternative embodiment, at least one of the longitudinal edges 209, 211 of the reinforcing insert 205 can generally line up with the longitudinal fold lines 162 or 164. Also, the reinforcing insert 205 can overlap one or more of the end flaps 112, 114, 122, 124, 142, 144 without departing from the disclosure.

Figure 5:
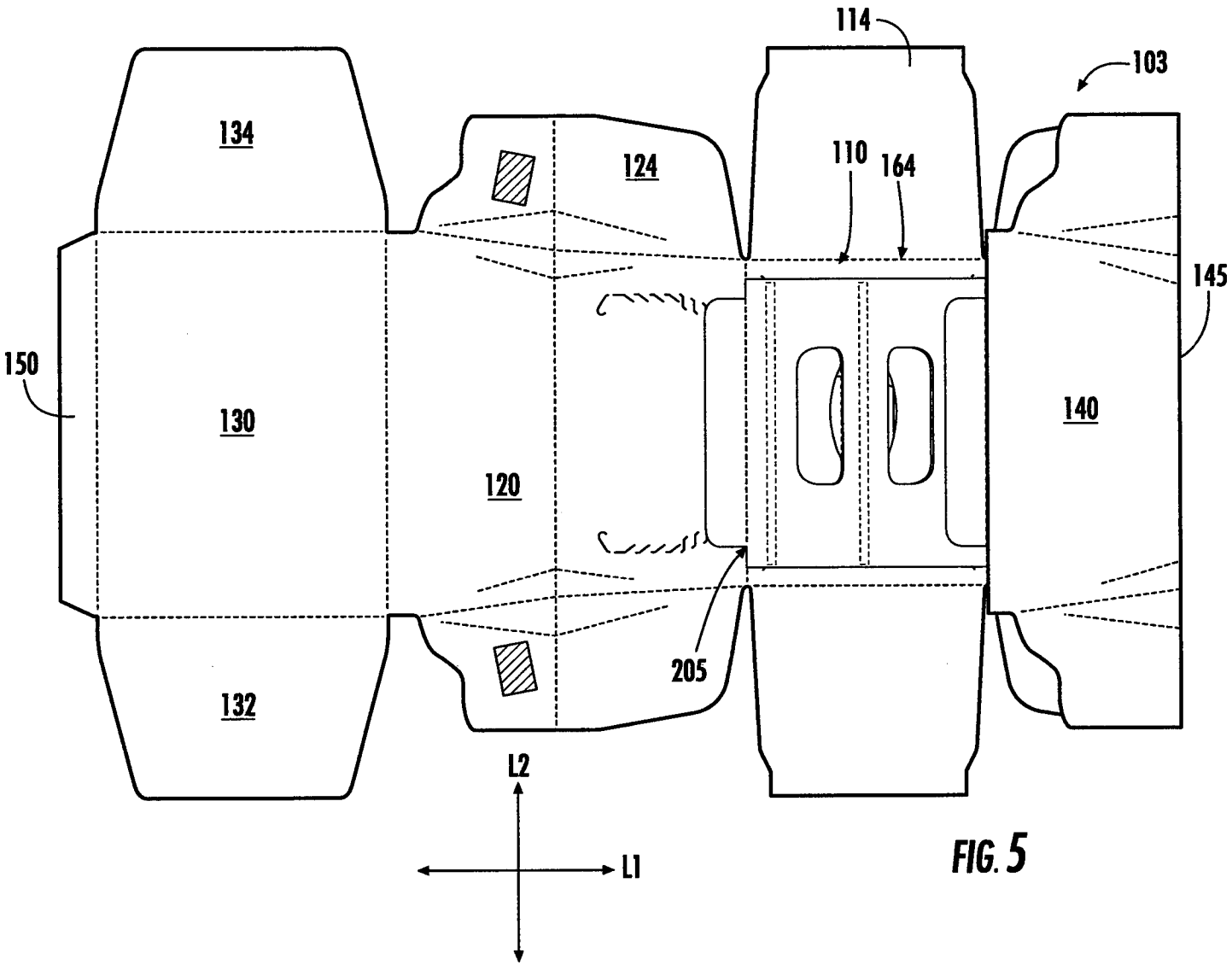
FIGS. 5 and 6 are views showing the folding of the carton blank to form the open-ended sleeve.
Figure 6:
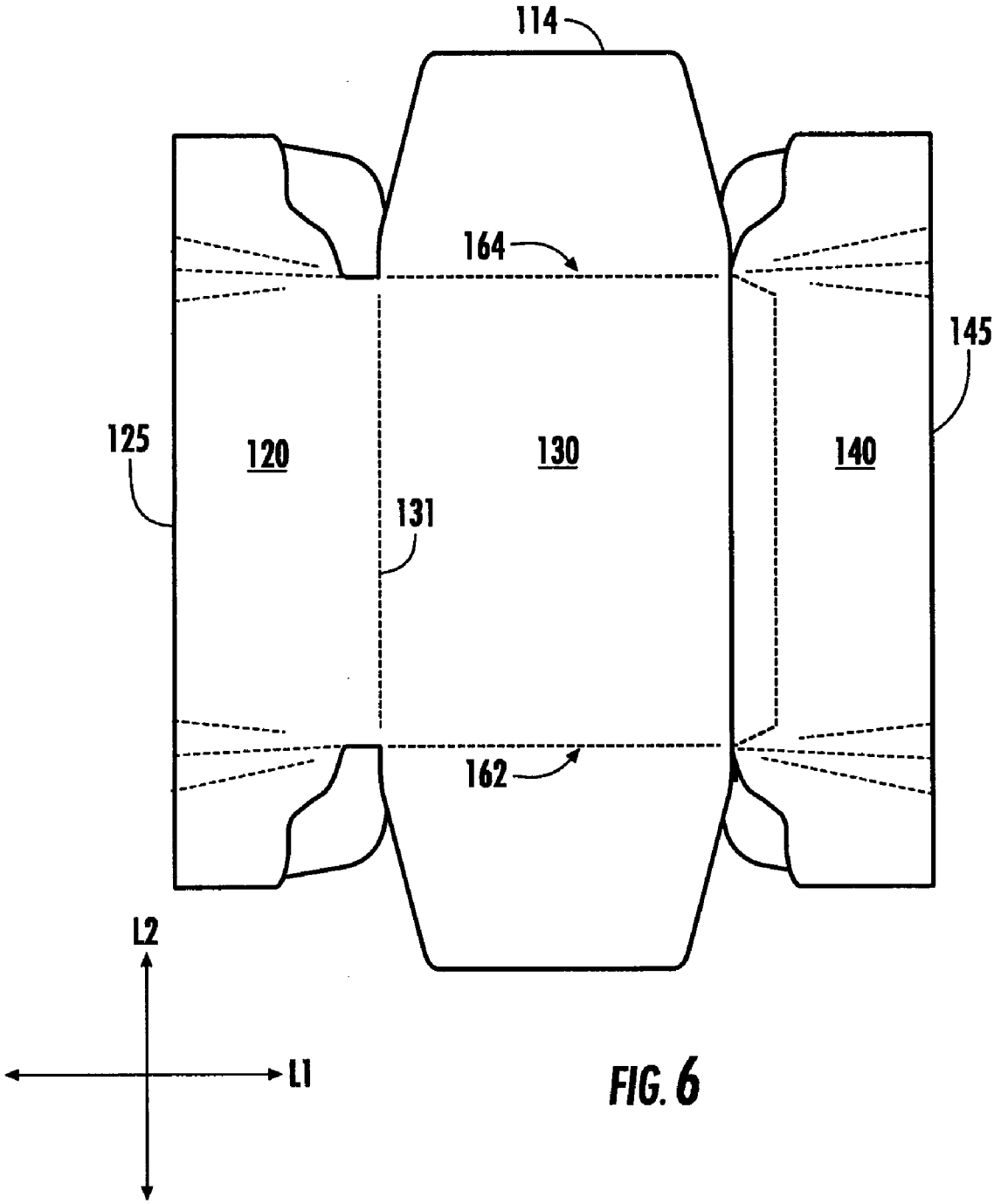
Figure 7:
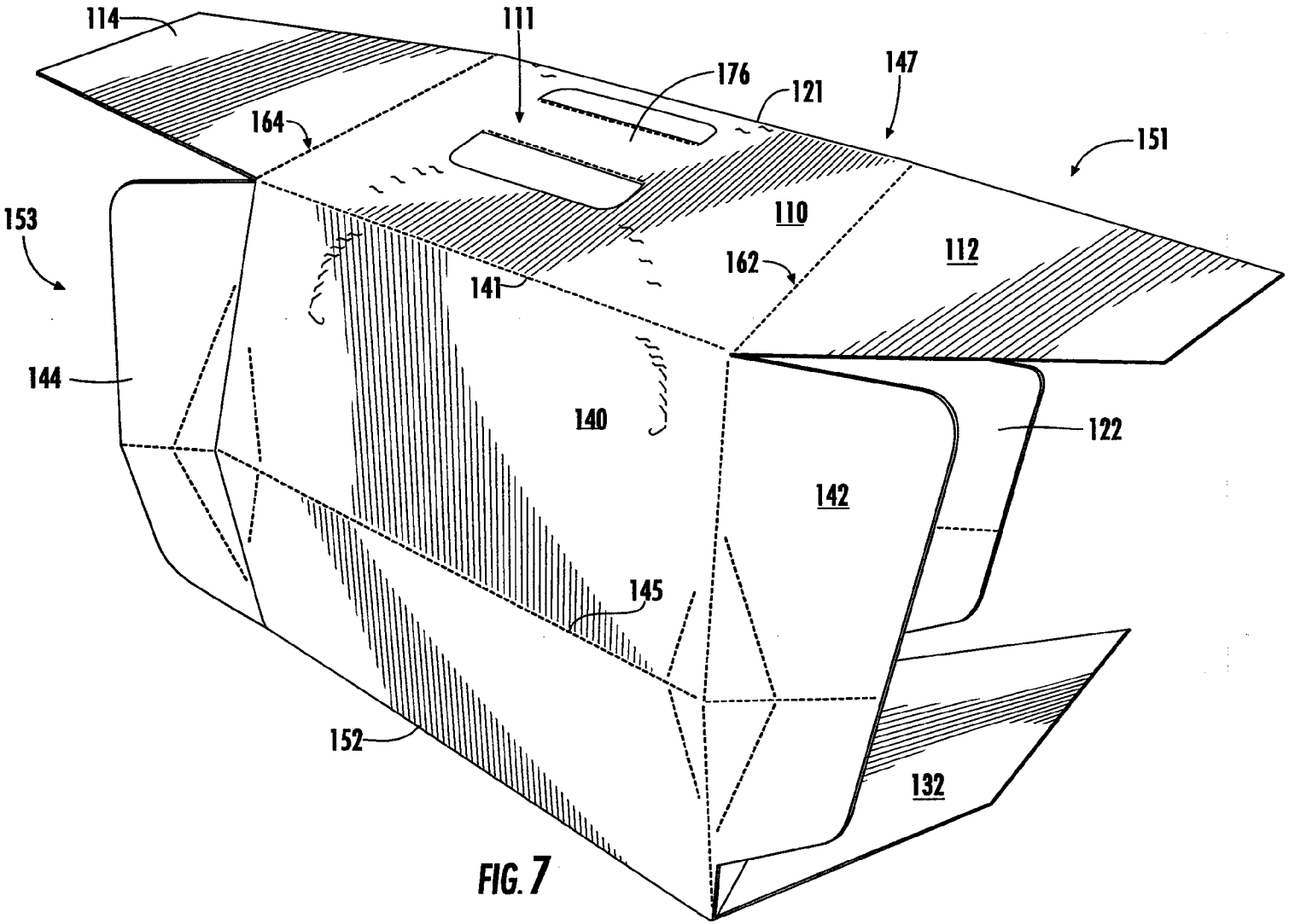
FIG. 7 is a perspective view of the open-ended sleeve according to one embodiment of the disclosure.
Figure 8:
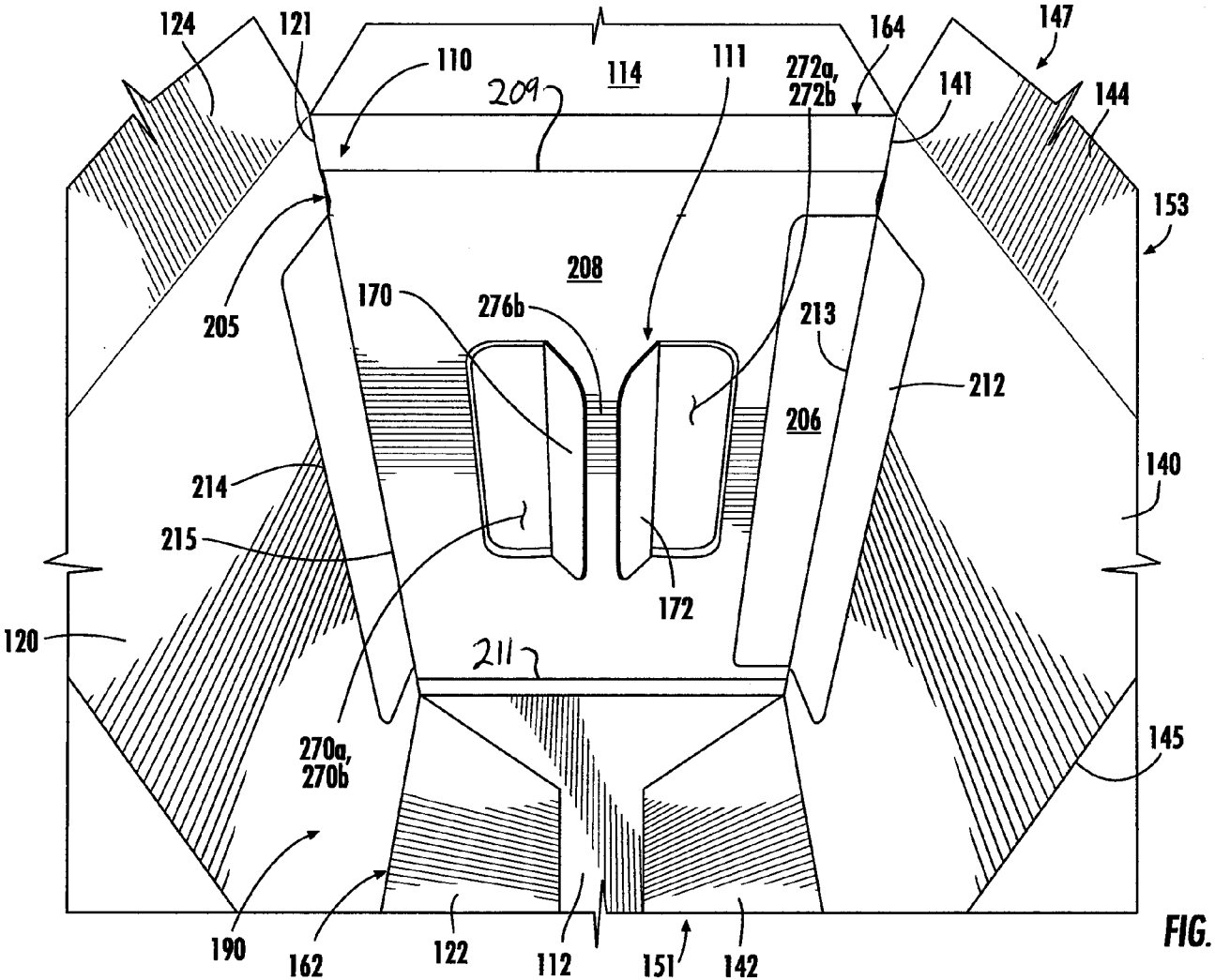
FIG. 8 is a perspective view of the interior of the sleeve.

In accordance with the exemplary embodiment, the carton blank 103 with insert blank 203 attached thereto can be further erected into the carton 105 by folding along fold lines 145 and 125 (FIGS. 5 and 6) and adhering the adhesive flap 150 to the second side panel 140. The adhesive flap 150 may be glued to the interior surface of the second side panel 140 (FIG. 6) or the exterior surface of the second side panel 140. Subsequently, the carton blank 103 is folded about lateral fold lines 121, 131, 141, 151 to form a sleeve 147 (FIGS. 7, 8, and 9) with a carton interior 190 (FIGS. 8 and 9). Further, alternative folding steps may be used without departing from the scope of this disclosure.

In the illustrated embodiment once the blank 103 is formed into the sleeve 147 (FIG. 7), the containers C may be loaded in the carton 105 from the first end 151 and then the first end may be closed by overlapping and gluing the side end flaps 122, 142 and top and bottom end flaps 132, 142, and then the second end may be closed by overlapping and gluing the side end flaps 124, 144 and top and bottom end flaps 114, 134. The assembled carton 105, shown in FIG. 10, looks similar to other cartons from the outside with the reinforcing insert 205 concealed within the carton. Alternative assembling, loading, and closing steps may be used without departing from the scope of this disclosure (e.g., the second end 153 can be closed, and then the containers C may be loaded into the sleeve 147).

The handle 111 can be used to grasp the carton 105 by pressing against the elongate handle flaps 170, 172, folding them inward along respective fold lines 171, 173, to create a pair of handle openings in the top panel 110 of the carton 105 (FIG. 8). The elongate handle flap 170 is folded inward through overlapped openings 270*a*, 270*b* and the elongate handle flap 172 is folded inward through the overlapped openings 272*a*, 272*b*. The hand guards 278 also fold inward along fold lines 271. The hand guards 278 and the handle flaps 170, 172 provide cushioning and extra support for the user's hands, and protect the hands from the edges of the handle openings 270*a*, 272*a*, 270*b*, 272*b*.

It is understood that the carton 105 may have an alternative number of handles or no handles or that the handle 111 can be otherwise shaped, arranged, and/or located without departing from the disclosure. Further, other opening arrangements for the handle 111 can be provided.

The reinforcing insert 205 provides extra layers of material for a three-ply top panel in the carton 105 surrounding the handle 111. The reinforcing insert 205 therefore reinforces the carton 105 by increasing the strength and rigidity of the carton to prevent tearing or other failure when the carton is lifted at the handle 111. Further, the first side flap 212 and the second side flap 214 restrict buckling in the respective side panels 140 and 120. The reinforcing insert 205 allows the carton 105 to carry heavier materials, have thinner walls, or both.

It is understood that the carton 105 can include a dispenser 180 (FIG. 1) formed of tear lines, cut lines, or other lines or areas of weakening 182, wherein the lines extend across one or more of panels 110, 120, 140 or other panels or flaps. The dispenser 180 may include lines of weakening in the reinforcing insert 205 as well to facilitate access to the containers C within the carton.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extend at least partially around an interior of the carton, the plurality of panels comprising a top panel, a first side panel, a second side panel, and a bottom panel;

a first plurality of end flaps at least partially closing a first end of the carton, the plurality of end flaps comprising a first side end flap connected to the first side panel at a longitudinal fold line and a second side end flap connected to the second side panel at the longitudinal fold line;

a reinforcing insert comprising at least a first insert panel foldably connected to a second insert panel and a first insert flap foldably connected to the first insert panel at a first insert fold line, wherein the first insert panel is at least partially in face-to-face contact with at least the top panel and the second insert panel is at least partially in face-to-face contact with the first insert panel;

wherein the first insert panel is foldably connected to the second insert panel at at least one fold line that is collinear with the first insert fold line.

2. The carton of claim 1, wherein the second insert panel is adhered to the first insert panel and the first insert panel is adhered to the top panel.

3. The carton of claim 1, wherein the first insert flap is at least partially in face-to-face contact with the second side panel and the reinforcing insert comprises a second insert flap at least partially in face-to-face contact with the first side panel.

4. The carton of claim 3, wherein the first insert flap is adhered to the second side panel and the second insert flap is adhered to the first side panel.

5. The carton of claim 3, wherein the top panel is foldably connected to the first side panel at a first transverse fold line, the top panel is foldably connected to the second side panel at a second transverse fold line, and the second insert flap is foldably connected to the second insert panel at a second insert fold line, wherein the first insert fold line generally overlaps the second transverse fold line along the length of the first insert fold line, and wherein the second insert fold line generally overlaps the first transverse fold line along the length of the second insert fold line.

6. The carton of claim 1, further comprising a handle in at least the top panel, the handle comprising at least one handle flap foldably connected to a handle strip, wherein each of the first and second insert panels defines at least one handle opening generally aligned with the at least one handle flap.

7. The carton of claim 6, wherein the at least one handle flap comprises a first handle flap and a second handle flap situated on either side of the handle strip, wherein the at least one handle opening comprises a first handle opening, a second handle opening, a third handle opening, and a fourth handle opening, the first and second handle openings being in the first insert panel and the third and fourth handle openings being in the second insert panel, and wherein the first and third handle openings are generally aligned with the first handle flap and the second and fourth handle openings are generally aligned with the second handle flap.

8. The carton of claim 1, wherein a first side fold line extends at least across the first side panel and the first side end flap, and a second side fold line extends at least across the second side panel and the second side end flap.

9. The carton of claim 1, wherein the first plurality of end flaps further comprises a top end flap connected to the top panel at the longitudinal fold line and a bottom end flap foldably connected to the bottom panel at the longitudinal fold line.

10. The carton of claim 1, further comprising a second plurality of end flaps at least partially closing a second end of the carton.

11. The carton of claim 1, further comprising a handle in at least the top panel, the handle comprising at least a first handle flap and a second handle flap foldably connected to either side of a handle strip.

12. The carton of claim 11, further comprising a plurality of dispenser tear lines extending in at least the top panel and the first side panel, wherein the plurality of dispenser tear lines in the top panel are situated at least between the first handle flap and a fold line connecting the top panel to the first side panel.

13. The carton of claim 11, wherein the handle further comprises a plurality of oblique fold lines in the top panel, each oblique fold line of the plurality of oblique fold lines extending from the handle strip toward a respective corner of the top panel.

14. In combination, a carton blank and an insert blank for forming a carton having reinforced features, the carton blank comprising:

a plurality of panels comprising a top panel, a first side panel, a second side panel, and a bottom panel;

the insert blank comprising:

at least a first insert panel foldably connected to a second insert panel and a first insert flap foldably connected to the first insert panel at a first insert fold line, wherein the first insert panel is at least partially in face-to-face contact with at least the top panel and the second insert panel is at least partially in face-to-face contact with the first insert panel and wherein the first insert panel is foldably connected to the second insert panel at at least one fold line that is collinear with the first insert fold line.

15. The combination of claim 14, wherein the insert blank comprises a second insert flap foldably connected to the second insert panel at a second insert fold line.

16. The combination of claim 15, further comprising a handle in at least the top panel, the handle comprising at least one handle flap foldably connected to a handle strip, wherein each of the first and second insert panels defines at least one handle opening for being generally aligned with the at least one handle flap.

17. The combination of claim 16, wherein the at least one handle flap comprises a first handle flap and a second handle flap situated on either side of the handle strip, wherein the at least one handle opening comprises a first handle opening, a second handle opening, a third handle opening, and a fourth handle opening, the first and second handle openings being in the first insert panel and the third and fourth handle openings being in the second insert panel.

18. The combination of claim 16, further comprising a plurality of dispenser tear lines extending in at least the top panel and the first side panel, wherein the plurality of dispenser tear lines in the top panel are situated at least between the first handle flap and a fold line connecting the top panel to the first side panel.

19. The combination of claim 16, wherein the handle further comprises a plurality of oblique fold lines in the top panel, each oblique fold line of the plurality of oblique fold lines extending from the handle strip toward a respective corner of the top panel.

20. The combination of claim 15, further comprising a first plurality of end flaps extending along a first marginal area of the carton blank, the plurality of end flaps comprising a first side end flap connected to the first side panel at a longitudinal fold line and a second side end flap connected to the second side panel at the longitudinal fold line.

21. The combination of claim 20, wherein a first side fold line extends at least across the first side panel and the first side end flap, and a second side fold line extends at least across the second side panel and the second side end flap.

22. A method of forming a carton comprising:

obtaining a carton blank comprising a plurality of panels comprising a top panel, a first side panel, a second side panel, and a bottom panel;

a plurality of end flaps extending along a marginal area of the carton blank, and the method further comprises folding the plurality of end flaps to close the at least one open end; said plurality of end flaps comprise a first side end flap connected to the first side panel at a longitudinal fold line and a second side end flap connected to the second side panel at the longitudinal fold line;

obtaining an insert blank comprising at least a first insert panel foldably connected to a second insert panel and a first insert flap foldably connected to the first insert panel at a first insert fold line;

positioning the first insert panel to be at least partially in face-to-face contact with at least the top panel; and positioning the second insert panel to be at least partially in face-to-face contact with at least the first insert panel;

wherein the first insert panel is foldably connected to the second insert panel at at least one fold line that is collinear with the first insert fold line.

23. The method of claim 22, wherein the insert blank further comprises a second insert flap foldably connected to the second insert panel at a second insert fold line, and wherein the forming the reinforcing insert further comprises attaching the first insert flap to the second side panel and attaching the second insert flap to the first side panel.

24. The method of claim 23, wherein the top panel is foldably connected to the first side panel at a first transverse fold line, the top panel is foldably connected to the second side panel at a second transverse fold line, and the second insert flap is foldably connected to the second insert panel at a second insert fold line, wherein the positioning the first insert panel comprises aligning the first insert fold line to generally overlap the second transverse fold line along the length of the first insert fold line, and wherein the positioning the second insert panel comprises aligning the second insert fold line to generally overlap the first transverse fold line along the length of the second insert fold line.

25. The method of claim 22, wherein the first insert panel is attached to the top panel and the second insert panel is attached to the first insert panel.

26. The method of claim 22, further comprising positioning the top panel, the first and second side panels, and the bottom panel to form an interior of the carton, the forming the interior of the carton comprising forming a sleeve having at least one open end.

27. The method of claim 26, further comprising placing a plurality of articles in the interior of the carton.

28. The method of claim 27, wherein a first side fold line extends at least across the first side panel and the first side end flap, and a second side fold line extends at least across the second side panel and the second side end flap.

29. The method of claim 22, wherein the carton blank further comprises a handle in at least the top panel, the handle comprising at least one handle flap foldably connected to a handle strip, wherein each of the first and second insert panels defines at least one handle opening generally aligned with the at least one handle flap.

30. The method of claim 29, wherein the at least one handle flap comprises a first handle flap and a second handle flap situated on either side of the handle strip, wherein the at least one handle opening comprises a first handle opening, a second handle opening, a third handle opening, and a fourth handle opening, the first and second handle openings being in the first insert panel and the third and fourth handle openings being in the second insert panel, and wherein the positioning the first insert flap and the positioning the second insert flap comprise generally aligning the first and third handle openings with the first handle flap and the second and fourth handle openings with the second handle flap.

31. A carton for containing a plurality of articles, the carton comprising:

a plurality of panels that extend at least partially around an interior of the carton, the plurality of panels comprising a top panel, a first side panel, a second side panel, and a bottom panel;

a reinforcing insert comprising at least a first insert panel foldably connected to a second insert panel, wherein the first insert panel is at least partially in face-to-face contact with at least the top panel and the second insert panel is at least partially in face-to-face contact with the first insert panel;

wherein the second insert panel is adhered to the first insert panel and the first insert panel is adhered to the top panel;

wherein the top panel is foldably connected to the first side panel at a first transverse fold line, the top panel is foldably connected to the second side panel at a second transverse fold line, the first insert flap is foldably connected to the first insert panel at a first insert fold line, and the second insert flap is foldably connected to the second insert panel at a second insert fold line, wherein the first insert fold line generally overlaps the second transverse fold line along the length of the first insert fold line, and wherein the second insert fold line generally overlaps the first transverse fold line along the length of the second insert fold line.

32. A method of forming a carton comprising:

obtaining a carton blank comprising a plurality of panels comprising a top panel, a first side panel, a second side panel, and a bottom panel;

obtaining an insert blank comprising at least a first insert panel foldably connected to a second insert panel;

positioning the first insert panel to be at least partially in face-to-face contact with at least the top panel; and positioning the second insert panel to be at least partially in face-to-face contact with at least the first insert panel;

wherein the insert blank further comprises a first insert flap foldably connected to the first insert panel at a first insert fold line and a second insert flap foldably connected to the second insert panel at a second insert fold line, and wherein the forming the reinforcing insert further comprises attaching the first insert flap to the second side panel and attaching the second insert flap to the first side panel.

* * * * *